US005562253A

United States Patent [19]

Henderson et al.

[11] Patent Number: 5,562,253

[45] Date of Patent: Oct. 8, 1996

[54] THROUGHPUT EFFICIENCY ENHANCEMENT OF FLUIDIZED BED JET MILL

[75] Inventors: K. Derek Henderson, Rochester; Lewis S. Smith, Fairport; Philip O. Sliva, Victor, all of N.Y.

[73] Assignee: Xerox Corporation, Stamford, Conn.

[21] Appl. No.: 409,125

[22] Filed: Mar. 23, 1995

[51] Int. Cl.[6] ..... B02C 19/06

[52] U.S. Cl. ..... 241/5; 241/40

[58] Field of Search ..... 241/5, 39, 40, 241/79.1, 80, 19

[56] References Cited

U.S. PATENT DOCUMENTS

| | | | |
|---|---|---|---|
| 3,565,348 | 12/1971 | Dickerson et al. | 241/5 |
| 4,059,231 | 11/1977 | Neu | 241/5 |
| 4,089,472 | 5/1978 | Siegel et al. | 241/5 |
| 5,133,504 | 7/1992 | Smith et al. | 241/5 |
| 5,277,369 | 1/1994 | Moriya et al. | 241/40 |

FOREIGN PATENT DOCUMENTS

| | | | |
|---|---|---|---|
| 1076141 | 2/1984 | U.S.S.R. | 241/40 |

*Primary Examiner*—Mark Rosenbaum
*Attorney, Agent, or Firm*—John L. Haack

[57] ABSTRACT

A fluidized bed jet mill for grinding particulate material comprising: a) a grinding chamber having a peripheral wall, a base, and a central axis; b) an impact target with a hollow cavity defined thereby, and with at least three apertures transversing the walls thereof, said target being mounted within said grinding chamber and centered on said central axis of said grinding chamber; and c) a plurality of sources of high velocity gas, said gas sources being mounted in said grinding chamber in said peripheral wall, arrayed symmetrically about said central axis, and oriented to direct high velocity gas along an axis substantially perpendicularly intersecting said central axis within said impact target, each of said sources of high velocity gas comprising a nozzle having an internal diameter; wherein said impact target has a cross section area in a plane parallel to said central axis, and said cross section area is greater than said cross section area of said internal diameter of said nozzle; and wherein the distance between said impact target and any of said nozzles is greater than said internal diameter of said nozzle.

21 Claims, 5 Drawing Sheets

THROUGHPUT EFFICIENCY ENHANCEMENT OF FLUIDIZED BED JET MILL

CROSS REFERENCE TO COPENDING ISSUED PATENTS

Attention is directed to commonly owned and assigned U.S. Pat. No. 5,133,504, issued Jul. 28, 1992, entitled "THROUGHPUT EFFICIENCY ENHANCEMENT OF FLUIDIZED BED JET MILL".

The disclosure of the above mentioned patent is incorporated herein by reference in its entirety.

BACKGROUND OF THE INVENTION

Fluid energy, or jet, mills are size reduction machines in which particles to be ground (feed particles) are accelerated in a stream of gas such as compressed air or steam, and ground in a grinding chamber by their impact against each other or against a stationary surface in the grinding chamber. Different types of fluid energy mills can be categorized by their particular mode of operation. Mills may be distinguished by the location of feed particles with respect to incoming air. In the commercially available Majac jet pulverizer, produced by Majac Inc., particles are mixed with the incoming gas before introduction into the grinding chamber. In the Majac mill, two streams of mixed particles and gas are directed against each other within the grinding chamber to cause fracture of the particles. An alternative to the Majac mill configuration is to accelerate within the grinding chamber particles that are introduced from another source. An example of the latter is disclosed in U.S. Pat. No. 3,565,348 to Dickerson, et al., which shows a mill with an annular grinding chamber into which numerous gas jets inject pressurized air tangentially.

During grinding, particles that have reached the desired size must be extracted while the remaining, coarser particles continue to be ground. Therefore, mills can also be distinguished by the method used to classify the particles. This classification process can be accomplished by the circulation of the gas and particle mixture in the grinding chamber. For example, in "pancake" mills, the gas is introduced around the periphery of a cylindrical grinding chamber, short in height relative to its diameter, inducing a vorticular flow within the chamber. Coarser particles tend to the periphery, where they are ground further, while finer particles migrate to the center of the chamber where they are drawn off into a collector outlet located within, or in proximity to, the grinding chamber. Classification can also be accomplished by a separate classifier. Typically, this classifier is mechanical and features a rotating, vaned, cylindrical rotor. The air flow from the grinding chamber can only force particles below a certain size through the rotor against the centrifugal forces imposed by the rotation of the rotor. The size of the particles passed varies with the speed of the rotor; the faster the rotor, the smaller the particles. These particles become the mill product. Oversized particles are returned to the grinding chamber, typically by gravity.

Yet another type of fluid energy mill is the fluidized bed jet mill in which a plurality of gas jets are mounted at the periphery of the grinding chamber and directed to a single point on the axis of the chamber. This apparatus fluidizes and circulates a bed of feed material that is continually introduced either from the top or bottom of the chamber. A grinding region is formed within the fluidized bed around the intersection of the gas jet flows; the particles impinge against each other and are fragmented within this region. A mechanical classifier is mounted at the top of the grinding chamber between the top of the fluidized bed and the entrance to the collector outlet.

The primary operating cost of jet mills is for the power used to drive the compressors that supply the pressurized gas. The efficiency with which a mill grinds a specified material to a certain size can be expressed in terms of the throughput of the mill in mass of finished material for a fixed amount of power produced by the expanding gas. One mechanism proposed for enhancing grinding efficiency is the projection of particles against a plurality of fixed, planar surfaces, fracturing the particles upon impact with the surfaces. An example of this approach is disclosed in U.S. Pat. No. 4,059,231 to Neu, in which a plurality of impact bars with rectangular cross sections are disposed in parallel rows within a duct, perpendicular to the direction of flow through the duct. The particles entrained in the air stream passing through the duct are fractured as they strike the impact bars. U.S. Pat. No. 4,089,472 to Siegel, et al. discloses an impact target formed of a plurality of planar impact plates of graduated sizes connected in spaced relation with central apertures through which a particle stream can flow to reach successive plates. The impact target is interposed between two opposing fluid particle streams, such as in the grinding chamber of a Majac mill.

Although fluidized jet mills can be used to grind a variety of particles, they are particularly suited to grinding other materials, such as toners, used in electrostatographic reproducing processes. These toner materials can be used to form either two component developers, typically with a coarser powder of coated magnetic carrier material to provide charging and transport for the toner, or single component developers, in which the toner itself has sufficient magnetic and charging properties that carrier particles are not required. The single component toners are composed of, for example, resin and a pigment such as commercially available MAPICO Black or BL 220 magnetite. Compositions for two component developers are disclosed in U.S. Pat. Nos. 4,935,326 and 4,937,166 to Creatura et al.

In the aforementioned and cross referenced U.S. Pat. No. 5,133,504 to Smith et al., is disclosed a fluidized bed jet mill with a grinding chamber with a peripheral wall, a base, and a central target, mounted within the grinding chamber and centered on the chamber central target. Multiple sources of high velocity gas are mounted in the peripheral wall of the grinding chamber, are arrayed symmetrically about the central axis, and are oriented to direct high velocity gas along an axis intersecting the central axis of the grinding chamber. Each of the gas sources has a nozzle holder, a nozzle mounted in one end of the holder oriented toward the grinding region, and optionally an annular accelerator tube mounted concentrically about the nozzle holder. The end of the accelerator tube closer to the nozzle is larger in diameter than the nozzle holder and the opposite end of the accelerator tube. The accelerator tube and the nozzle holder define between them an annular opening through which particulate material in the grinding chamber can enter and be entrained with the flow of gas from the nozzle and accelerated within the accelerator tube to be discharged toward the impact target centered on the central axis. These embodiments can be combined for further efficiency enhancement. A problem associated with solid body impact target is that the target may suffer mechanical stress and wear from continuous particle bombardment, particularly in an annular area substantially defined by the circular perimeter created by the particle gas stream projected onto the target. The complexities and concommitant economics associated with maintenance and replacement of the target assemblies can be considerable.

The toners are typically melt compounded into sheets or pellets and processed in a hammer mill to a mean particle size of between about 400 to 800 microns. They are then ground in the fluid energy mill to a mean particle size of between 3 and 30 microns. Such toners have a relatively low density, with a specific gravity of approximately 1.7 for single component and 1.1 for two component toner. They also have a low glass transition temperature, typically less than 70° C. The toner particles will tend to deform and agglomerate if the temperature of the grinding chamber exceeds the glass transition temperature.

Although the fluidized bed jet mill is satisfactory, it could be enhanced to provide a significant improvement in grinding efficiency. The Siegel and Neu disclosures are directed to mills in which the particles are mixed with the gas jet flows that are outside the grinding chamber and as such are not suited for use in a fluidized bed mill. The Smith et al., disclosure is directed to a fluidized bed jet mill apparatus for grinding particles which grinding is achieved by impinging the particle streams against a solid impact target. Thus, there is a need for an improved apparatus and method for enhancing the grinding efficiency of a fluidized bed jet mill.

SUMMARY OF THE INVENTION

It is an object of the present invention to overcome deficiencies of prior art devices described above and to provide grinding equipment and grinding processes with improved grinding efficiency and throughput.

It is another object of the present invention, in embodiments to provide a fluidized bed jet mill that has a grinding chamber with a peripheral wall, a base, a central axis, and a rigid impact target with a hollow interior or internal cavity, and a plurality of openings or apertures for material transport therethrough. The target is mounted within the grinding chamber and centered on or near the central axis of the chamber. Multiple sources of high velocity gas are mounted about the peripheral wall of the grinding chamber, are arrayed symmetrically about the central axis, and are oriented to direct at least a portion of the high velocity gas streams, having particles entrained therein, towards and through input apertures of the impact target along an axis which is approximately perpendicular to the central axis and intersecting other particle streams at about the center of the impact target, wherein enhanced particle comminution and jet mill throughput result.

In still another object of the present invention is provided, in embodiments, a fluidized bed jet mill for grinding particulate material comprising: a grinding chamber with a peripheral wall, a base, and a central axis; at least one plate type impact target with at least one aperture therethrough, the impact target being mounted within the grinding chamber and centered about an axis which is perpendicular to and intersecting the central axis of the grinding chamber; a plurality of sources of high velocity gas, the gas sources being mounted within the grinding chamber, arrayed coplanar and symmetrically about the central axis, and oriented to direct high velocity gas along an axis intersecting the central axis at a point, each of the sources of high velocity gas comprises a nozzle having an internal diameter; wherein the impact target has a impact cross section in a plane parallel to the central axis, the impact cross section area being from about 1 to about 25 times the internal cross sectional area of the nozzle; wherein the minimum distance of the impact target to any of the nozzles is from about 0.5 to about 25 times the internal diameter of the nozzle; wherein the impact target is situated between the nozzle and the central axis, and the cylindrical axis of the aperture is substantially colinear with the perpendicular axis; and wherein the aperture has a cross section geometry which is substantially the same as the cross section geometry of the nozzle.

It is another object of the present invention to provide, in embodiments, for the aforementioned input apertures, particularly for those apertures which are directly impacted with an entrained particle gas stream, an aperture insert member or article which defines an internal cross section of the aperture and an aperture splash area, wherein the aperture insert member has a cross section area of from about 1.5 to about 25 times the cross section area of the nozzle orifice, the aperture insert member cross section area is of from about 1.5 to about 100 times the cross section area of the aperture, wherein the internal cross section area of the nozzle is from about 1.0 to about 0.1 of the internal cross sectional area of the aperture, and wherein the insert member structurally and mechanically reinforces the splash area against wear and abrasion from particulate eduction through the aperture and particulate collisions with the aperture insert member.

It is another object of the present invention to provide, in embodiments, a fluidized bed jet mill further comprising an annular accelerator tube for use in conjunction with the aforementioned rigid impact targets of either the hollow bodied type and plate type geometries. The annular accelerator tube is mounted concentrically about the high velocity gas stream axis and is coaxially situated downstream from the nozzle and a nozzle holder. The end of the accelerator tube closer to the nozzle is larger in diameter than the nozzle holder and the opposite end of the accelerator tube. The accelerator tube and the nozzle holder define between them an annular opening through which fluidized particulate material in the grinding chamber can enter and be entrained with the flow of gas from the nozzle and efficiently accelerated within the accelerator tube to be discharged toward the central axis of the chamber and an impact target concentrically positioned about an axis perpendicular to the central axis.

In yet another object of the present invention, in embodiments, is provided a method of grinding particles which comprise: introducing unground particles into a grinding chamber of a fluidized bed jet mill; injecting high velocity gas from a plurality of sources of high velocity gas; forming a fluidized bed of the unground particle; accelerating a portion of the particles with the high velocity gas to form a high velocity particle gas stream; fracturing the portion of the particles into smaller particles by projecting the particle gas stream partially against and partially through a rigid and hollow, impact target with a plurality of apertures therein mounted within the grinding chamber; separating from the unground particles and the smaller particles a portion of the smaller particles smaller than a selected size; discharging the portion of the smaller particles from the grinding chamber; and continuing to grind the remainder of the smaller particles and the unground particles until the smaller particles smaller than a selected size are obtained thereby. In embodiments, the toner particles, that result from separating the aforementioned smaller particles from the larger particles, have a mean diameter of about 3 to about 30 microns.

It is another object of the present invention to provide a method for grinding particles of electrostatographic developer material comprising: a) introducing unground particles of electrostatographic developer material into a grinding chamber of a fluidized bed jet mill; b) injecting high velocity gas from a plurality of sources of high velocity gas attached to injecting nozzles; c) forming a fluidized bed of the unground particles; d) accelerating a portion of the particles to form a particle stream with the high velocity gas; e) fracturing a portion of the accelerated particles into smaller particles by projecting at least two particle streams at a rigid and hollow, impact target residing within the grinding chamber, with the target having at least three apertures therein which allows substantially all the gas and a portion of the particles to transgress into and out of the impact target, so that substantially all of the particles accelerated by the gas stream impact the aperture splash area, for example, in a circumferential pattern corresponding to the periphery of the gas stream and substantially all the gas passes through the aperture and can thereafter further entrain and accelerate other particles; f) separating from the unground particles and the smaller particles a portion of the smaller particles smaller than a selected size; g) discharging the portion of the smaller particles from the grinding chamber; and h) continuing to grind the remainder of the smaller particles and the unground particles until smaller particles, smaller than a selected size, are obtained thereby.

Another object of the present invention relates to processes for the preparation of toner particles by jet mill grinding of coarser particles into finer particles which includes the combined grinding action and efficiency of particle-stationary wall impingement and particle-particle stream impingement.

In yet another object of the present invention is provided, in embodiments, a fluidized bed jet mill wherein the aforementioned hollow body impact target, the aforementioned plate type impact target, and the aforementioned accelerator tube, can be combined or used in multiples for further configurational and throughput efficiency enhancement.

It is an object of the present invention to provide simple and economical processes and apparatus for grinding particulate materials.

In another object of the present invention is the provision of high efficiency processes and apparatus for grinding particulate materials.

Other features and advantages of the present invention will be apparent to those skilled in the art from the following detailed description of the invention.

DETAILED DESCRIPTION OF THE INVENTION

Figure 1:
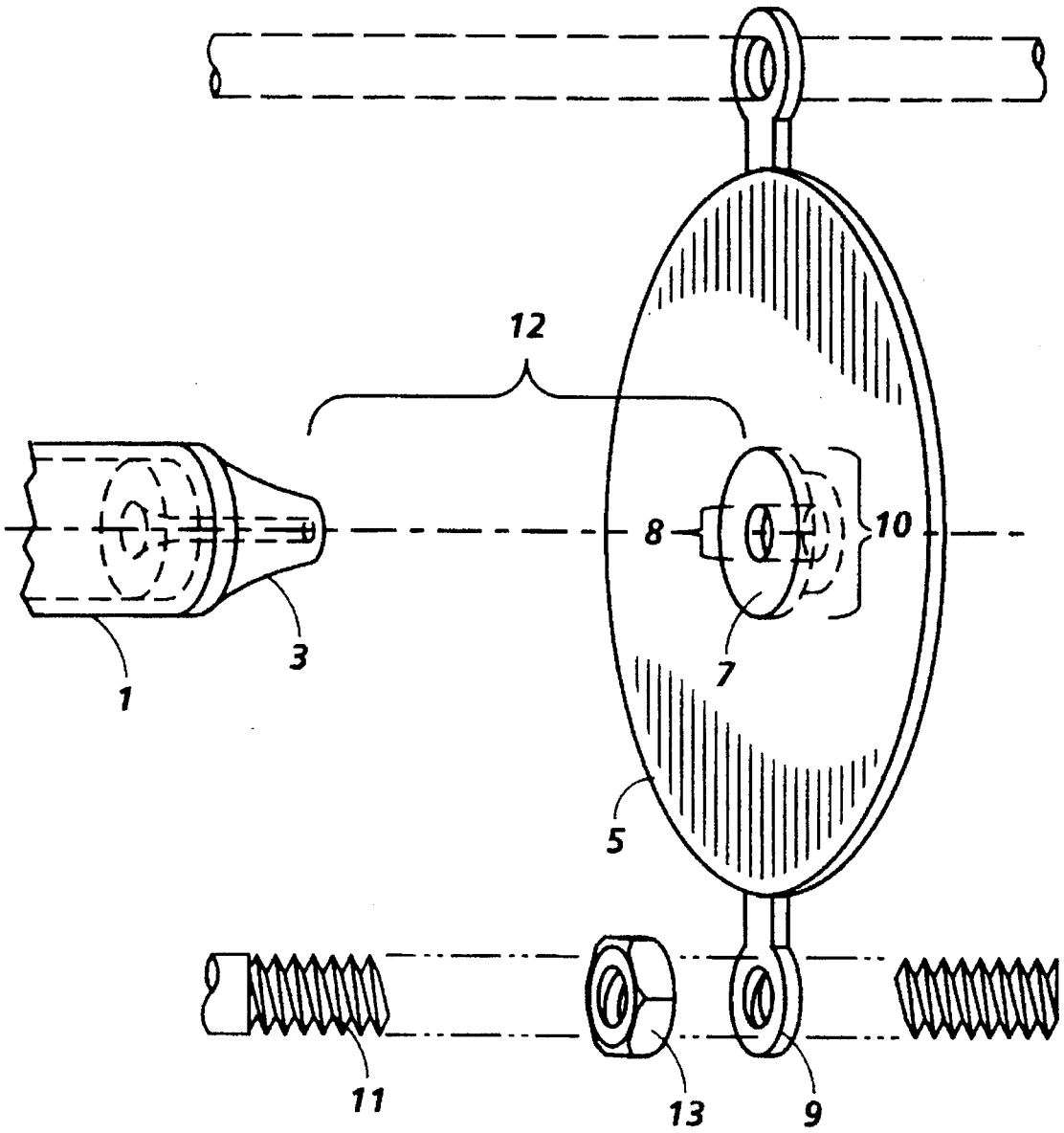
FIG. 1 is a schematic representation of a flat plate impact target with an aperture therethrough and an aperture insert, wherein the target is situated a distance from a gas nozzle suitable for the processes of the present invention.

The present invention provides, in embodiments, improvements in the jetting efficiency of the prior art fluid bed jet mill by employing an apparatus and method for grinding. The apparatus, in embodiments, comprises: a fluidized bed jet mill for grinding particulate material comprising: a) a grinding chamber having a peripheral wall, a base, and a central axis; b) an impact target with a hollow cavity defined by the internal walls of the impact target, and with at least three apertures transversing the walls thereof, the target being mounted within the grinding chamber and centered on or near the central axis of the grinding chamber; and c) a plurality of sources of high velocity gas, the gas sources being mounted within the grinding chamber or on the peripheral wall, arrayed symmetrically about the central axis, and oriented to direct high velocity gas along an axis substantially perpendicularly intersecting the central axis, the central axis being situated within the impact target, each of the sources of high velocity gas comprises a nozzle having an internal diameter or an internal cross-sectional area for discharging compressed gas; wherein the impact target has a cross section in a plane parallel to the central axis, the cross section being between 5 and 500 times the internal diameter of the nozzle; and wherein the distance between the impact target and any of the nozzles is from about 0.5 to about 25 times the internal diameter of the nozzle. The rigid hollow bodied impact target has a substantially three dimensional geometry which may be convexly arcuate, concavely arcuate, prismatic, and combinations thereof, and more particularly, a sphere, a cylinder, or a prism having faces or facets in an amount equal to the number of said nozzles, with at least one of the apertures directed to the central axis for escape of particles from the internal cavity of the impact target, and at least two input apertures disposed about different axes defined by the long axis or cylindrical axis of the nozzles. The rigid and hollow bodied impact targets can be positioned within and fixed to the interior of the grinding chamber with, for example, a mounting member which may be attached to the base of the chamber and to the impact target. In another embodiment, the hollow bodied impact targets can be positioned within and fixed to the interior of the grinding chamber with a mounting member which joins the hollow bodied impact target to the peripheral wall of the grinding chamber, or alternatively, attached to a nozzle holder fitted about the nozzle jet. The impact targets, which are preferrably continuously bombarded by the particles contained in particle gas stream, are preferrably constructed of a rigid, abrasion and impact resistant material.

In a preferred embodiment, a fluidized bed jet mill of the present invention comprises a grinding chamber having a peripheral wall, a base, a central axis, and a convexly arcuate hollow bodied impact target, with three small input apertures therethrough to permit gas entrained particles to partially pass therethrough into the cavity within the target, and two exit apertures substantially larger than the three small input apertures, to permit particles to escape from or exit from the interior of the impact target for the subsequent removal from, and or recycling, that is, particles from or within, for example, the grinding chamber. The input apertures are further fitted with aperture insert liners or members to provide an impact and abrasion resistant surface for particle impingement and comminution. The aperture inserts can be readily installed or removed from the impact target for cleaning or replacement. The hollow bodied impact target, with or without the aperture insert installed, has a cross sectional impact surface area approximately in a plane perpendicular to the axis of the particle gas stream and parallel to the central axis that is from about 5 to about 500 times or larger than the internal cross-sectional area of the nozzle. The distance between the hollow bodied impact target and any of the nozzles is from about 2 to about 20 times the internal diameter of the nozzle. The nozzle diameter or cross section can be any size such that the aforementioned relative dimensional relationships between the nozzle and impact target are achieved, for example, nozzle diameters from about 4.0 to about 20.0 millimeters provide for suitable particle gas streams of the present invention.

With reference to FIG. 1, a nozzle holder 1 and nozzle 3 are situated about a common axis with a plate type impact target 5. The plate type impact target 5 with an aperture therein has, in embodiments, an aperture insert or liner 7. The aperture insert 7 has an aperture or opening 8 and an outer diameter 10. The area between the internal diameter 8 and the outer diameter 10 of the aperture insert is referred to as the impact area or splash area. The impact area or splash area sustains substantially all the particle impacts from particles which do not pass through the aperture insert orifice and through the aperture. The target 5 may have appended support members 9 or equivalent means which are used to attach the plate type impact target or the hollow bodied impact target to rod support members 11 for supporting the target in a high velocity gas or particle stream. The rod member 11 may be optionally threaded and fasteners 13 may be optionally used to the fix position of target 5 on the rod 11 to establish a separation distance 12 between the target 5 and the tip of nozzle 3. The plate type impact targets have cross sectional impact areas, for example, from about 5 to about 500 times the internal cross section of the gas nozzle, and the internal cross sectional area of the nozzle is from about 1.0 to about 0.1 of the internal cross sectional area of the apertures.

A principal function of the aperture insert member 7 is to provide a highly durable particle impact surface. A second function of the insert member is to provide a impact surface which minimizes the amount and the cost, of high abrasion resistant coating materials used so that only the aperture insert member if desired need be fabricated and coated with the highly abrasion resistant materials, and not the entire impact target. A third function of the insert member is to provide a readily replaceable or interchangeable impact surface that does not require complicated and expensive disassembly of, for example, supporting or fastening componentry. The insert member can be fixed into position in the rigid wall of the impact target by known fastening methods, for example, a high tolerance machined beveled edge slip fit, snap fit, pressure fit, ball bearing seat clamp, and the like. The fastening method chosen preferably provides an essentially stationary aperture insert member and impact target assembly under the continuous action of an impinging particle gas stream.

The aperture insert liner is constructed from a suitably abrasion and impact resistant material, such as ferrous and non ferrous metals, and ceramic monoliths, or alterntively, a suitably rigid material with an optional abrasion resistant coating thereover, such as, a ceramic, metal/ceramic composite, metal film, diamond film, metal alloy, impact resistant polymers, filled polymer composites, and the like, and combinations thereof. The aperture insert 7 and internal diameter 8 is about equal to or greater than the internal diameter of the nozzle. The aperture insert member has a cross section area of from about 1.5 to about 25 times the internal cross section area of the nozzle, and the aperture insert cross section impact area is of from about 1 to about 100 times the cross section area of the aperture, and the internal cross sectional area of the nozzle is from about 1.0 to about 0.1 of the internal cross sectional area of the apertures. The impact target preferably has a impact cross section which forms an annulus or ring approximately in a plane parallel to the central axis. The impact area cross section is from about 1.5 to about 25 times greater than the cross sectional area of the nozzle. The impact area cross section or "spray" pattern of the particle stream is projected for distribution partially on the aperture splash area and partially into the aperture opening thereby allowing a portion of the particles contained in the entrained particle gas stream to pass through the target without impacting the target. Particles can also pass through the target after contact with, or deflection by, the aperture insert member, or by re-entrainment of particles by the gas stream passing through the aperture. The distance 12 between the nozzle 3 and the target 5 may vary considerably depending upon the operating conditions of the grinder desired, such as velocity in the high velocity gas stream, the concentration of particles entrained in the stream, the internal diameter of the nozzle, the number of nozzles employed, the annular area of the particle stream as the particles impinge upon the impact target, and the like, and can be from about 0.5 to about 25 times the internal cross section of the nozzle.

Figure 2:
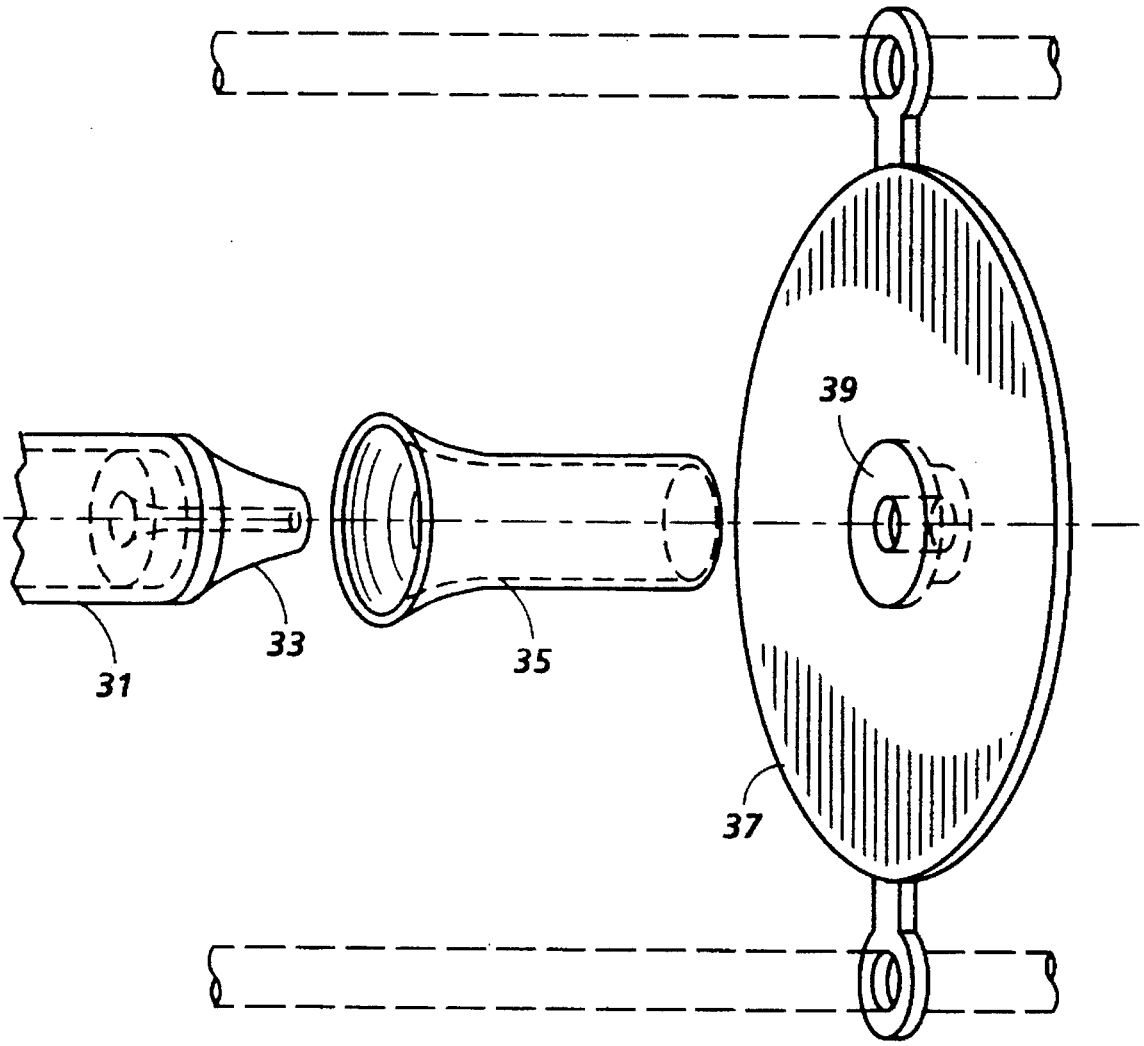
FIG. 2 is a schematic representation of a partial grinder configuration comprising a flat plate impact target with an aperture, an aperture insert, and a nozzle, with an accelerator tube situated between the nozzle and the impact target.

In FIG. 2, is shown another embodiment of the present invention, comprising the configuration of FIG. 1 comprising nozzle holder 31, nozzle 33, plate type impact target 37, and aperture insert member 39 and further comprising an accelerator tube 35. The accelerator tube is annular and is mounted approximately concentrically about the nozzle holder and the aperture in the impact target, and having a first end proximal to the nozzle and a second end distal from the nozzle, each first end and second end having an internal diameter, the internal diameter of the first end being larger than the internal diameter of the second end and being larger then the external diameter of the nozzle holder, the accelerator tube and the nozzle holder defining an annular opening therebetween through which particulate material in the grinding chamber can enter and be entrained with a high velocity flow of gas from the nozzle, accelerated within the accelerator tube by the gas, and discharged toward the impact target. The accelerator tube may be constructed from any suitably rigid material which is abrasion resistant such as ferrous and non ferrous metals, and ceramic monoliths or in the alternative, a suitably rigid material with an abrasion resistant coating thereover, for example, a ceramic, metal/ceramic composite, metal film, metal alloy, and the like, and combinations thereof, for example a ferrous alloy coated with an abrasion resistant ceramic material. A preferred ceramic coating material is, for example, HEANIUM®. The nozzle tip or accelerator tube, in embodiments, can also act as a collimator, or choke point, to further concentrate, focus or direct the spread pattern of the entrained particles in the gas stream as the particle gas stream exits the accelerator tube. The choke feature can, in embodiments, be used to regulate the quantity of entrained particles that pass through the aperture insert, or alternatively, the quantity of particles which impact the aperture insert. The accelerator tube in embodiments, comprises a cylindrical outlet portion distal from the nozzle and a converging or truncated portion proximal to the nozzle. The converging portion of the accelerator tube is shaped as a body of rotation formed by rotating an arc convex to the axis of the nozzle, the converging portion having an internal diameter at its distal end equal to the internal diameter of the cylindrical portion.

Figure 3A:
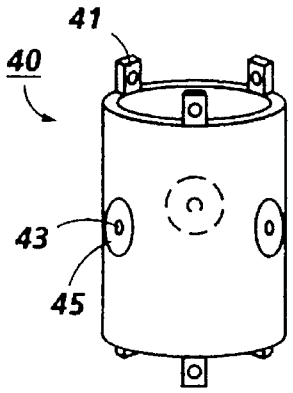
FIGS. 3A, 3B, and 3C illustrate in perspective exemplary geometries of convexly arcuate, hollow bodied, impact targets of the present invention.
Figure 3B:
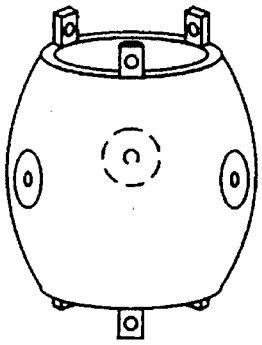
Figure 3C:
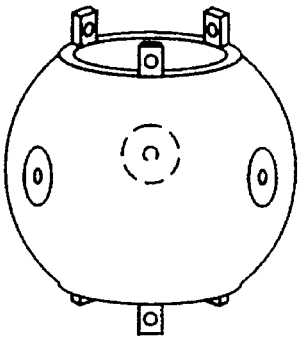
Figure 3D:
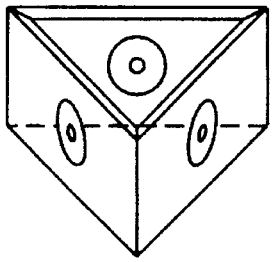
FIGS. 3D, 3E, and 3F illustrate in perspective exemplary geometries of prismatic impact targets with a cavity therein of the present invention.
Figure 3E:
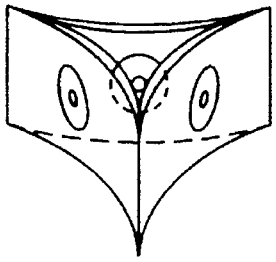
Figure 3F:
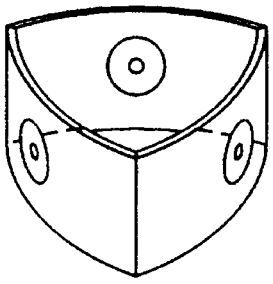

With reference to FIGS. 3A through 3F, there are illustrated representative, however not limiting, geometries of the hollow bodied impact target embodiment, wherein the impact target 40 with optional mounting tabs 41 for affixing the target to the peripheral chamber wall or an extension thereof is particularly shown in FIG. 3A. The opening or aperture 43 and aperture insert member 45, specifically the aforementioned splash area, are preferrably flush with the outer surface of the impact target. As illustrated in FIGS. 3A through 3F, the impact target 40 may be: cylindrical such as 3A; any combination of cylindrical and spherical geometry, for example, as illustrated in 3B; spherical as illustrated in 3C; and prismatic wherein the prism has a regular shape, that is having flat faces or facets, or alternatively, wherein the facets are convex or concave as shown in FIGS. 3E and 3F, respectively. Mounting or support tabs 41 are present in sufficient numbers to enable fastening and supporting the impact target securely within the chamber and at a desired height such that the apertures 43 are properly aligned and colinear with the gas jet nozzle. The aperture inserts 45 may be flush with as shown, inset or recessed within, or raised above the impact surface of the target surface. The relative location of the support tabs 41 with respect to the apertures 43 is not believed to be particularly critical so long as the impact target can be be securely fastened in a stationary position in the appropriate location within the grinding chamber with respect to the nozzles and the desired particle size reduction and operating efficiencies are achieved. In embodiments, the aperture inserts 45 are fashioned from cast HEANIUM® and the impact target or insert holder 40 is fashioned from stainless steel.

Figure 4:
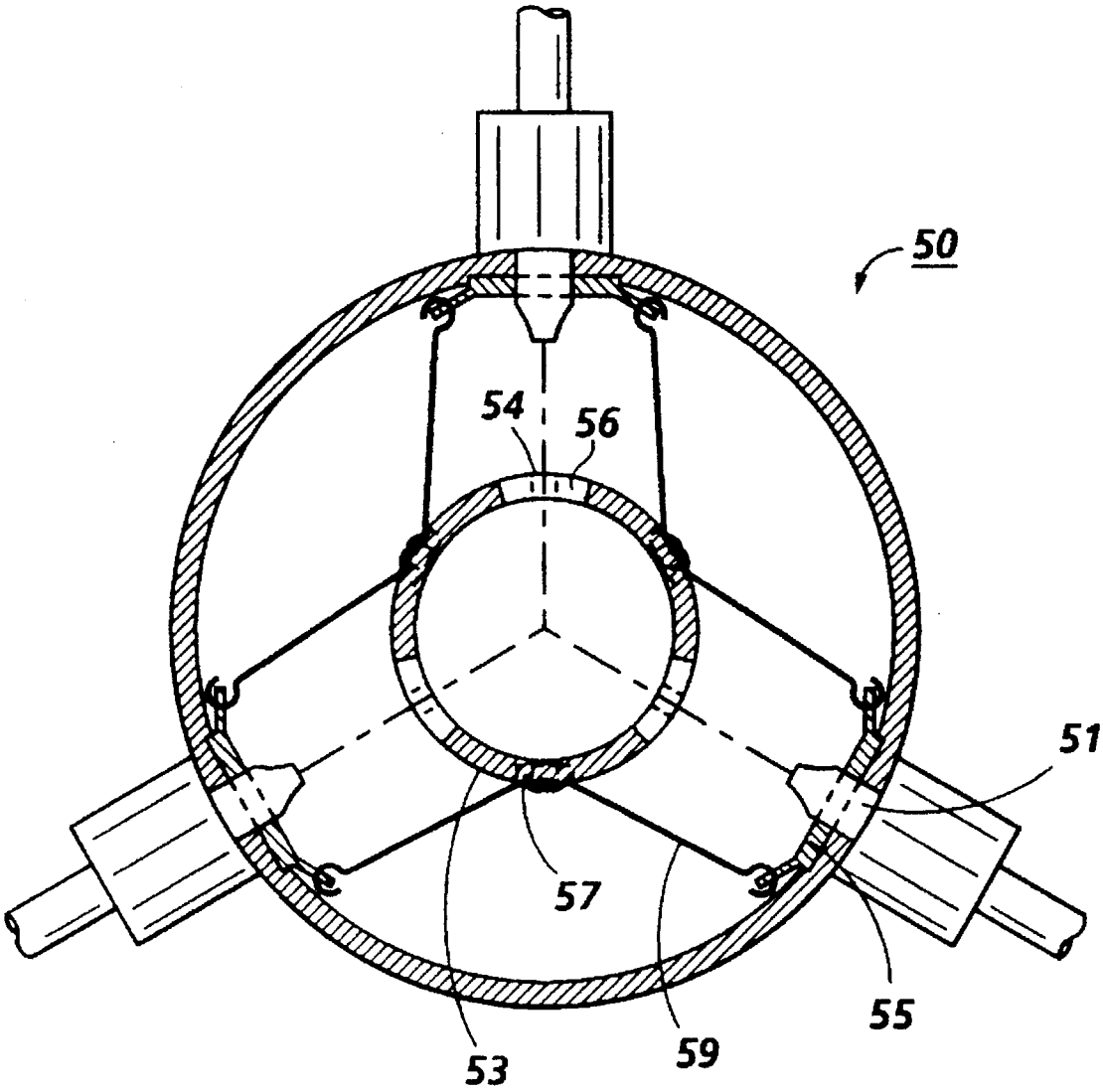
FIG. 4 is a schematic representation in section, of a fluidized bed jet mill with an exemplary hollow, convexly arcuate impact target constructed according to the principles of the present invention.

With reference to FIG. 4, shown is a schematic representation in section of a fluidized bed jet mill 50 with a nozzle 51. The nozzle directs entrained particles in a gas stream at and through impact target 53 having in the embodiment illustrated, three input apertures 54 and aperture inserts 56 fitted therein for the purpose of partial passage and partial impingement of particles on the aperture splash area. Nozzle ring or nozzle holder 55 and target tab support 57 are connected by support rods 59 thereby providing suspended and rigid support to the hollow, convexly arcuate impact target 53.

Figure 5:
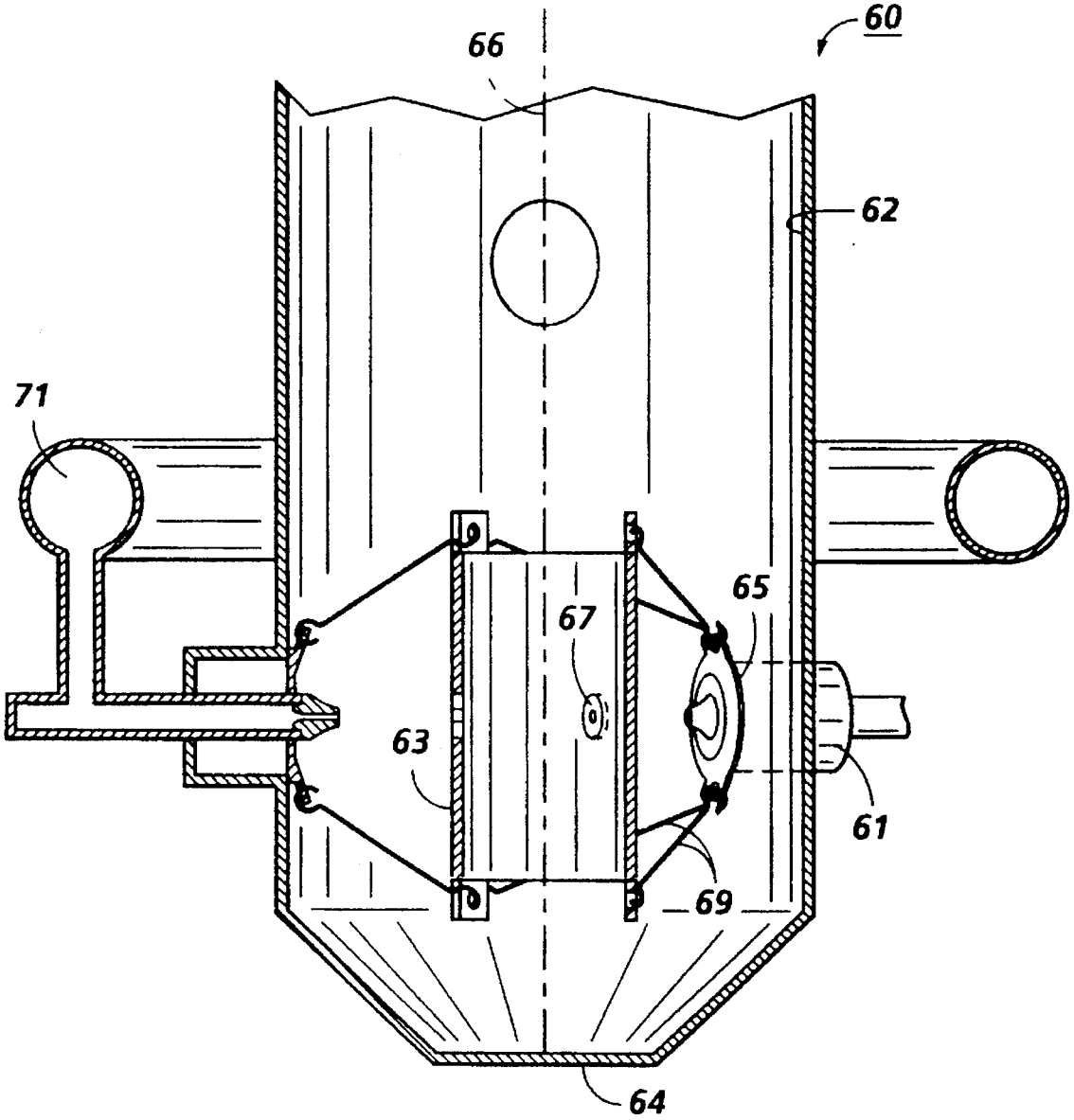
FIG. 5, is a schematic representation in section, in plan, of a fluidized bed jet mill with an exemplary hollow, convexly arcuate impact target therein, constructed according to the principles of the present invention.

FIG. 5, shows in plan section, a hollow, convexly arcuate impact target embodiment. A single-chamber fluidized bed jet mill 60 having an internal cavity or chamber defined by the peripheral inner walls 62, a base 64 and a central axis 66. The grinding chamber has a grinding zone which comprises the lower half of the chamber, and a classification zone which comprises the upper half of the chamber. Product to be ground can be introduced into the grinding chamber in a variety of ways known to those skilled in the art, such as through an opening or inlet in the chamber wall other than the nozzle ports. Ground particles are lifted to the aforementioned upper classification zone and are classified by a classifier rotor (not shown) and discharged from the grinding chamber through a classified product outlet (not shown). A source of compressed gas, such as steam or air, supplies the gas to the compressed gas nozzle holders 61 through compressed gas manifold 71. The nozzles mounted in the nozzle holders 61, inject the compressed gas into grinding zone. The nozzles can be spaced equally around the periphery of grinding zone and can be arranged in a plane which is generally perpendicular to the central axis 66 of the grinding chamber. The nozzle axes intersect at about a point common with the nozzle axis or plane and the central axis 66. As is well known in the art, a fluidized bed of feed material is formed during operation of the mill in the grinding zone. The target 63 can suspended in position substantially as shown in FIG. 4, for example, wherein nozzle holders 65 are connected to the impact target 63 such that the nozzle 61 is co-aligned with the aperture and aperture insert 67 by way of mounting rods or support members 69.

The impact target alternatively can be mounted within the grinding chamber at one end of the target using a target mount (not shown) and attached to the base 64 of the grinding chamber or alternatively, with support rods as described for the flat plate target embodiment of FIG. 1. The target mount is also formed of a hard, rigid material, such as steel or ferrous metal which is compatible with the impact target and associated support tabs. The target can be affixed at a lower end to the base 64 of the grinding chamber by a conventional technique such as welding or threaded attachment. The attachment means should be sufficiently sturdy and rigid to prevent the target from moving or vibrating during operation and, like the target, can optionally have an abrasion resistant surface.

The relationship between the diameter of the grinding chamber in the particle interaction region and the nozzle internal diameter is such that the distance from the radially inner end of each nozzle to the intersection point of the nozzle axes at about the central axis is from about 2 to about 20 times the nozzle internal diameter.

In an embodiment, a hollow, cylindrically shaped impact target 63 is mounted within the grinding chamber by attaching the nozzle holder support 65 to the support tabs extending from the ends of the target with suspension support rods 69, centered on the nozzle intersection point coincident with the central axis 66. In the illustrated embodiment, the cylindrical impact target is mounted using, for example, a one inch diameter steel rod with hooks on both ends. The nozzles are mounted in or on the peripheral chamber wall such that the distance from the radially inner end of the nozzle to the nearest impact surface of the target is about 10 to about 90 percent of the distance from the nozzle to the nozzle intersection point at about the central axis. In an embodiment, the aforementioned nozzle suspension support rods 69 may be adapted and substituted by the aforementioned rod support members 11, reference FIG. 1.

The height of the rigid and hollow, impact target is about equal to the width in profile of the impact target, and with at least one exit aperture to provide for egress of gas and particles from within the interior of the impact target, and wherein this exit aperture is generally directed along or in the direction of the central axis.

The thickness of the wall of the aforementioned plate type or hollow bodied impact targets can be, in embodiments, from about 3 to about 30 millimeters, and which size may be determined from consideration of, for example, the contemplated gas velocity, particle size, particle type, desired particle size reduction levels, and throughput volumes and throughput efficiencies desired, the abrasiveness of the particulate material, and the presence or absence of an aperture insert member.

The thickness of the aperture insert is, in embodiments, from about 0.1 to about 30 millimeters, the thickness of abrasion and impact resistant coatings is from about 0.0001 to about 5.0 millimeters, and the relative ratio of the internal diameter to the external diameter of the aperture insert is, for example, from about 1.0:1.2 to about 1.0:5.0.

A jet mill with a plate type impact target can be either a flat plate, a convexly arcuate plate, or a concavely arcuate plate with respect to the direction of the impinging particle gas stream.

It will be readily understood by one of ordinary skill in the art upon comprehending the teachings of the present invention that, in embodiments, there can be selected a plurality or multiplicity of the aforementioned plate type impact targets, for example, wherein from 1 to about 5 plate type impact targets are colinearly situated between each nozzle and the central axis intersection point. Another embodiment contemplates a multiplicity of the aforementioned hollow bodied impact targets wherein the target apertures are colinearly situated between each nozzle and the central axis intersection point. The impact targets in such a configuration form a concentric or nested relation with respect to the other impact targets wherein the hollow bodied impact targets become smaller in size in order to be accommodated within the interior cavity of a larger outer hollow bodied impact target. In an embodiment, a multiplicity of the impact targets is selected and the targets are preferrably separated by, for example, approximately equal distances although other separation distances can be used if desired. In other embodiments, the impact targets may optionally employ an aperture insert member situated within the aperture, wherein the aperture insert defines an internal diameter of the aperture and an aperture splash area. The aperture insert member can have a cross section area ratio of from about 1.5 to about 25 times the internal cross section area of the nozzle, and which aperture insert cross section area ratio is of from about 1 to about 100 times the cross section area of the aperture, and the internal cross sectional area of the nozzle is from about 1.0 to about 0.1 of the internal cross sectional area of the apertures, and wherein the insert member is responsible for structurally and mechanically reinforcing the splash area against wear and abrasion from particulate eduction through, and particulate collisions, with the aperture insert member. In preferred embodiments, the aperture insert member is substantially flush with the outer surface of the impact target in either of the aforementioned impact target geometry embodiments, that is the plate type or the hollow bodied impact target geometries.

In embodiments of the present invention, particle size reduction is accomplished by particle-stationary wall impingement and particle-particle stream impingement. Thus, improved material throughput efficiency and power consumption efficiencies are realized and are believed to be improved because of the aforementioned combined action of the particle-target impingement and particle-particle impingement processes. The relative throughput efficiency improvements are, in embodiments, from about 5 to 30 percent, and relative throughput efficiency increases or improvements from about 2 to in excess of about 50 percent are believed to be attainable. Exemplary throughput improvements of the present invention are demonstrated hereinafter.

The high velocity particle gas stream creates, in embodiments, a conical shaped region with an apparent apex of the conical region emanating approximately from a point at, or within, the nozzle, and the base of the conical region is directed towards the impact target and the central axis of the conical region is perpendicular to the central axis, and wherein the particles contained in the particle gas stream are substantially contained in an annular area substantially defined by a perimeter of a circular conic section of the surface of the conical shaped region.

The impact target and the aperture insert are preferably formed of a hard, rigid material, such as steel, and the like materials. The material should be sufficiently rigid to not flex or vibrate during operation of the mill. The target is subject to noticeable abrasion by the material being ground after extended usage. For example, the iron oxide (a magnetite) in single component toners is more abrasive than many other toner materials. The target should therefore have a surface sufficiently hard to resist abrasion over a desired operating life of the target. The target surface may, in embodiments, be coated with an abrasion and heat resistant material, such as tungsten carbide, silicon carbide, amorphous carbon, diamond, or suitable ceramic material, or the target may be formed entirely of such materials. In embodiments, the impact target and the aperture insert may be constructed of the same or dissimilar materials. The impact target and the aperture insert may be readily fabricated by various known methods to those skilled in the art of material science, and the like disciplines, for example, by molding, machining, sol-gel casting, coating, chemical vapor deposition, sputtering, and related techniques.

The particulate material suitable for grinding and particle size reduction in the present invention can be toner, developer, resin, resin blends and alloys, filled thermoplastic resin composite particles, and the like particles. Unground particles are preferrably electrostatographic developer material particles with a mean diameter of about 5 to about 5,000 microns. The smaller or ground particles removed from the grinding chamber and process have a mean diameter of about 3 to about 30 microns. The parameters required to achieve desired particle size properties can be determined empirically and is a preferred practice in view of the large number of process variables.

Ground particles are suitable for use as electrostatographic developer material selected from the group consisting of single component and two component toner particles comprising a binder resin, a pigment, and optional additives. A suitable binder resin for particle size reduction in the present invention can have, for example, a broadly distributed molecular weight centered about approximately 60,000.

The invention will further be illustrated in the following nonlimiting Examples, it being understood that these Examples are intended to be illustrative only and that the invention is not intended to be limited to the materials, conditions, process parameters, and the like, recited herein. Parts and percentages are by weight unless otherwise indicated.

EXAMPLES

Exemplary and non limiting tests were conducted with the aforementioned aperture targets and demonstrated that, in general, the targets enhance the throughput efficiency of the fluidized bed jet mill, and specifically, planar targets with particular size apertures therein enhance throughput efficiencies in amounts of from 5 to about 30 relative percent compared to a mill without a target present. A Condux CGS-50 mill, similar in design and operation to the disclosed embodiments, was used in the testing. The mill has a grinding chamber with an internal diameter of approximately 24 inches and a height of approximately 60 inches. The mill was fitted with three equally spaced nozzles each with an internal diameter of 7.5 mm. The compressed gas was dry air supplied by a compressor at a constant pressure of 115 psia at a nominal air flow of 450 cubic feet per minute (cfm). The compressed air is intercooled to a stagnation temperature of about 70 to 80 degrees Fahrenheit before it entered the compressed air manifold. The mill was fitted with a standard mechanical classifier for the Condux CGS-50 mill.

The mill was tested in the following configurations: a) "as is" or the commercially available standard configuration without a planar target, an which configuration served as a baseline comparison value; b) with a planar target having no aperture; and c) with a planar target having a concentrically located aperture. Aperture targets were 7.5 inches in height by 1.5 inches wide by 0.5 inches deep. Planar targets were tested with four different aperture conditions: no aperture, 7.5 mm, 12.5 mm, and 25 mm aperture diameter. The target was situated at a distance of about 12 nozzle diameters away from the nozzle tip. The nozzle internal diameter in each of the Examples was 7.5 mm. Each aperture target was positioned normal to the nominal flow of the compressed gas. All of the aperture targets were attached to target mounts formed of 0.75 inch diameter threaded rod. Both the aperture targets and mounts were formed out of mild steel. Mill efficiency as used herein can be characterized by the expression $$E=T/\{Q \ln (P/P_o)\}$$

where E is efficiency, T is throughput in mass per unit time, for example, pounds per hour, Q is air flow rate, P is grind pressure, and $P_o$ is chamber pressure.

The feed material was a two component toner comprised, by weight, of approximately one fifth magnetite such as MAPICO Black T™, one twentieth carbon black, such as REGAL 330® and three quarters binder resin of poly(styrene butadiene) having a broadly distributed molecular weight centered about 60,000. The toner was ground from an initial mean diameter of 7,500 microns to a final mean diameter of approximately 10 microns.

The results indicate that the planar target provides about a 17% relative increase in throughput efficiency over the baseline configuration example. This is in accordance with the aforementioned commonly owned U.S. Pat. No. 5,133,505. Both the 7.5 mm and 12.5 mm aperture targets provide about an additional 50% greater relative throughput compared to the planar target without an aperture. The 25 mm aperture target configuration provides only marginal improvement in throughput efficiency (5%) compared to the baseline value, that is in the absence of a target, and suggests that an important relationship exists between the diameter of the aperture and the diameter or periphery of the particle gas stream. The relative percent increase throughput is calculated relative to the baseline result, for example, with a 7.5 mm aperture, a 55–44/44=25% increase was achieved. The increased relative throughput appears to correspond to the extent of target wear or erosion resulting from the particle impacts observed. For example, where the relative throughput improvement was about 25 to about 27 percent, the target wear was heavy to moderate based on visual inspection and weight loss. When the relative percent throughput increase was small, for example, about 5 percent, the wear was minimal.

The observed results for the above-mentioned examples are tabulated in the accompanying Table 1.

TABLE 1

| Test Configuration | Through-put (lbs/hr) | Mean Particle Size (micron) | Relative % Increase Throughput (micron) | Target Wear |
|---|---|---|---|---|
| Baseline - no target | 44 | 9.5 | — | — |
| Planar Target (no aperture) | 52 | 9.3 | 17 | Heavy |
| Aperture Target (7.5 mm aperture) | 55 | 9.4 | 25 | Heavy |
| Aperture Target (12.5 mm aperture) | 56 | 9.5 | 27 | Moderate |
| Aperture Target (25 mm aperture) | 46 | 9.5 | 5 | Minimal |

The aforementioned patents and publications are incorporated by reference herein in their entirety.

Other modifications of the present invention may occur to those skilled in the art based upon a review of the present application and these modifications, including equivalents thereof, are intended to be included within the scope of the present invention.

What is claimed is:

1. A fluidized bed jet mill for grinding particulate material comprising:

a) a grinding chamber having a peripheral wall, a base, and a central axis;

b) an impact target with a hollow cavity defined thereby, and with at least three apertures transversing the walls thereof, said target being mounted within said grinding chamber and centered on said central axis of said grinding chamber; and c) a plurality of sources of high velocity gas, said gas sources being mounted in said grinding chamber in said peripheral wall, arrayed symmetrically about said central axis, and oriented to direct high velocity gas along an axis substantially perpendicularly intersecting said central axis within said impact target, each of said sources of high velocity gas comprising a nozzle having an internal diameter; wherein said impact target has a cross section area in a plane parallel to said central axis, and said cross section area is greater than the cross section area of said internal diameter of said nozzle; and wherein the distance between said impact target and any of said nozzles is greater than said internal diameter of said nozzle.

2. The fluidized bed jet mill of claim 1 wherein said impact target has a three dimensional geometry selected from the group consisting of convexly arcuate, concavely arcuate, and prismatic with at least one of said three apertures directed to said central axis and at least one of said three apertures being concentric about a cylindrical axis corresponding to the long axis of said nozzle.

3. The fluidized bed jet mill of claim 1 wherein said impact target has a substantially three dimensional geometry selected from the group consisting of a sphere, a cylinder, and a prism having impact faces or facets in an amount equal to the number of said nozzles, with at least one of said three apertures directed to said central axis which provides for particulate and gas escape from the interior of said target, and at least one of said three apertures concentric about a cylindrical axis corresponding to the long axis of said nozzle, which provides for particulate and gas transport into the interior of said target.

4. The fluidized bed jet mill of claim 3 further comprising at least one aperture insert member fitted within said at least one of said three apertures providing interior transport which defines an internal diameter of an aperture and an aperture splash area, wherein said aperture insert member has a cross section area of from about 1.5 to about 25 times the internal cross section area of the nozzle, and the aperture insert cross section area is of from about 1.5 to about 100 times the cross section area of the aperture providing interior transport, wherein the internal cross section area of the nozzle is from about 1.0 to about 0.1 of the internal cross sectional area of the aperture providing interior transport, and wherein said insert member structurally and mechanically reinforces said splash area and the internal edge of the aperture providing interior transport against wear and abrasion from particulate eduction through the aperture and particulate collisions with said aperture insert member.

5. The fluidized bed jet mill of claim 4 wherein the aperture insert member is an aperture liner comprised of an abrasion and impact resistant material.

6. The fluidized bed jet mill of claim 4 wherein the thickness of the wall of the impact target is from about 3 to about 30 millimeters.

7. The fluidized bed jet mill of claim 4 wherein the thickness of the aperture insert is from about 0.1 to about 30 millimeters, and the relative ratio of the internal diameter to the external diameter of the aperture insert is from about 1:1 to about 1:5.

8. The fluidized bed jet mill of claim 4 wherein the aperture insert member is substantially flush with the outer surface of the impact target.

9. The fluidized bed jet mill of claim 1 further comprising a mounting member having a first end and a second end, said first end being attached to said base of said chamber and said second end being attached to said impact target.

10. The fluidized bed jet mill of claim 1 further comprising at least one mounting member having a first end and a second end, said first end being attached to said peripheral wall of said chamber and said second end being attached to said impact target.

11. The fluidized bed jet mill of claim 1 further comprising a nozzle holder for said nozzle, and at least one mounting member having a first end and a second end, said first end being attached to said nozzle holder and said second end being attached to said impact target.

12. The fluidized bed jet mill of claim 1 wherein said impact target is comprised of an abrasion and impact resistant material.

13. The fluidized bed jet mill of claim 1 wherein each of said sources of high velocity gas comprises:

a) a nozzle holder having a central axis and an outside diameter;

b) a nozzle mounted in one end of said nozzle holder oriented toward said impact target and having an internal diameter; and c) an annular accelerator tube mounted concentrically about said nozzle holder and having a first end proximal to said nozzle and a second end distal from said nozzle, each of said first end and said second end having an internal diameter, said internal diameter of said first end being larger than said internal diameter of said second end and being larger then the external diameter of said nozzle holder, said accelerator tube and said nozzle holder defining an annular opening therebetween through which particulate material in said grinding chamber can enter and be entrained with a flow of gas from said nozzle, accelerated within said accelerator tube by the gas, and discharged toward said impact target.

14. The fluidized bed jet mill of claim 13 wherein the high velocity particle gas stream creates a conical shaped region with the apex of the conical region directed towards the nozzle, and the base of the conical region is directed towards the impact target and central axis, and wherein the particles contained in the particle gas stream are substantially contained in an annular area substantially defined by the perimeter of circular conic sections of the conical region.

15. The fluidized bed jet mill of claim 13 wherein said accelerator tube comprises a cylindrical outlet portion distal from said nozzle and a converging portion proximal to said nozzle.

16. The fluidized bed jet mill of claim 15 wherein said converging portion of said accelerator tube is shaped as a body of rotation formed by rotating an arc convex to said axis of said nozzle, said converging portion having an internal diameter at its distal end equal to said internal diameter of said cylindrical portion.

17. The fluidized bed jet mill of claim 16 wherein said accelerator tube is formed of a ferrous alloy coated with an abrasion resistant ceramic material.

18. The fluidized bed jet mill of claim 1 wherein the particulate material is selected from the group of particles consisting of toner, developer, resin, resin blends and alloys, and filled thermoplastic resin composite particles.

19. The fluidized bed jet mill of claim 1 wherein the particle size reduction is accomplished by particle-stationary wall impingment and particle-particle stream impingment.

20. A method of grinding particles comprising:

a) introducing unground particles into a grinding chamber of a fluidized bed jet mill;

b) injecting high velocity gas from a plurality of sources of high velocity gas;

c) forming a fluidized bed of said unground particles;

d) accelerating a portion of said particles with said high velocity gas to form a high velocity particle gas stream;

e) fracturing said portion of said particles into smaller particles by projecting the particle gas stream partially against and partially through a rigid and hollow, impact target with a plurality of apertures therein mounted within said grinding chamber;

f) separating from said unground particles and said smaller particles a portion of said smaller particles smaller than a selected size;

g) discharging said portion of said smaller particles from said grinding chamber; and h) continuing to grind the remainder of said smaller particles and said unground particles until said smaller particles smaller than a selected size are obtained thereby.

21. A method for grinding particles of electrostatographic developer material comprising:

a) introducing unground particles of electrostatographic developer material into a grinding chamber of a fluidized bed jet mill;

b) injecting high velocity gas from a plurality of sources of high velocity gas attached to injecting nozzles;

c) forming a fluidized bed of said unground particles;

d) accelerating a portion of said particles to form a high velocity particle gas stream with said high velocity gas;

e) fracturing a portion of the accelerated particles into smaller particles by projecting at least two particle streams at a rigid and hollow, impact target residing within the grinding chamber, with the target having at least three apertures therein which allows substantially all the gas and a portion of the particles to transgress into and out of the impact target wherein at least two of said at least three apertures have an aperture splash area which is adjacent and concentric to said at least two apertures, so that substantially all of the particles accelerated by the gas stream thereby impact the aperture splash area in a circumferential pattern corresponding to the periphery of the gas stream and substantially all the gas passes through said at least two apertures and can thereafter further entrain and accelerate other particles;

f) separating from said unground particles and said smaller particles a portion of said smaller particles smaller than a selected size;

g) discharging said portion of said smaller particles from said grinding chamber; and h) continuing to grind the remainder of said smaller particles and said unground particles until said smaller particles smaller than a selected size are obtained thereby.

* * * * *